US011446558B2

(12) United States Patent
Pasternak

(10) Patent No.: US 11,446,558 B2
(45) Date of Patent: Sep. 20, 2022

(54) GAME APPARATUS AND METHOD

(71) Applicant: M. Randall Pasternak, Thiensville, WI (US)

(72) Inventor: M. Randall Pasternak, Thiensville, WI (US)

( * ) Notice: Subject to any disclaimer, the term of this patent is extended or adjusted under 35 U.S.C. 154(b) by 382 days.

(21) Appl. No.: 16/441,804

(22) Filed: Jun. 14, 2019

(65) Prior Publication Data

US 2020/0391089 A1 Dec. 17, 2020

(51) Int. Cl.

| | |
|---|---|
| ***A63B 67/06*** | (2006.01) |
| *A63F 7/00* | (2006.01) |
| *A63F 9/00* | (2006.01) |

(52) U.S. Cl.

CPC ..... *A63B 67/06* (2013.01); *A63F 7/0017* (2013.01); *A63F 2009/0058* (2013.01)

(58) Field of Classification Search

CPC . A63B 63/08; A63B 67/06; A63B 43/00–002; A63F 9/02–0204; A63F 9/0278; A63F 2009/0058; A63F 2009/0269; A63F 9/12; A63F 2009/1236; F42B 6/003; A47G 19/2227

USPC ..... D21/301, 707, 712, 714; D7/514–515, D7/539

See application file for complete search history.

(56) References Cited

U.S. PATENT DOCUMENTS 712,159 A * 10/1902 Voege ..... A63B 67/06 273/400
1,423,551 A * 7/1922 Adriance ..... F42B 6/003 473/582
2,092,162 A * 9/1937 Hiatt ..... A63F 9/0208 273/348.5
2,126,873 A * 8/1938 Czajkowski ..... A63F 9/0243 273/400
2,327,078 A * 8/1943 Teetor ..... A47G 23/02 220/23.83
3,351,344 A * 11/1967 Dupuy ..... A63B 63/08 273/400
4,169,596 A * 10/1979 Chinenson ..... A63F 9/02 273/401
4,186,925 A * 2/1980 Goldfarb ..... A63B 67/06 273/127 D
D259,354 S * 5/1981 Derrington ..... D21/707
4,266,781 A * 5/1981 Blue ..... A63F 9/0278 473/575
4,433,841 A * 2/1984 Kim ..... A63B 67/06 273/338
4,863,175 A 9/1989 Ricks, Jr. et al.
5,123,656 A 6/1992 Green
5,575,483 A 11/1996 Dineen et al.
5,692,979 A 12/1997 Jones
5,860,879 A * 1/1999 Gable ..... A63B 67/183 473/575

(Continued)

*Primary Examiner* — Laura Davison
(74) *Attorney, Agent, or Firm* — Ryan Kromholz & Manion, S.C.

(57) ABSTRACT

A apparatus and method for operating the apparatus of the present invention provide for a game apparatus incorporating malleable tossing objects and a container wherein the container provides for the ability to have an insert wherein the insert may provide for at least one rigid geometric object on which the malleable tossing object will deflect if the throw of the malleable tossing object lacks precision, further the apparatus provides for an adult beverage theme, and a method for operating the apparatus.

16 Claims, 9 Drawing Sheets

(56) References Cited

U.S. PATENT DOCUMENTS

| | | | | |
|---|---|---|---|---|
| 6,669,200 | B1 * | 12/2003 | Knetsch | A63B 63/007 273/400 |
| 7,428,864 | B2 * | 9/2008 | Wengrovsky | A47G 19/04 108/26 |
| D633,948 | S | 3/2011 | Roach et al. | |
| 8,651,492 | B1 | 2/2014 | Cappuccio | |
| 9,079,087 | B2 * | 7/2015 | Topolosky | A63F 7/0017 |
| 9,155,950 | B2 * | 10/2015 | Fernandez | A63B 67/06 |
| 9,192,837 | B2 * | 11/2015 | Nally | A63B 71/06 |
| 9,687,709 | B2 * | 6/2017 | Riniti | A63B 63/08 |
| 9,827,474 | B2 * | 11/2017 | Sciandra | A63B 67/007 |
| 10,130,861 | B2 | 11/2018 | Schirmer | |
| 2002/0130467 | A1 * | 9/2002 | Woods | A63B 67/06 273/398 |
| 2004/0063080 | A1 * | 4/2004 | Cheng | G09B 1/02 273/153 R |
| 2006/0001212 | A1 * | 1/2006 | Toland | A63F 9/12 273/156 |
| 2012/0065004 | A1 * | 3/2012 | Blackwell | A63B 71/0669 473/476 |
| 2012/0169012 | A1 | 7/2012 | Parker et al. | |
| 2014/0091525 | A1 | 4/2014 | Ramirez | |
| 2019/0051213 | A1 * | 2/2019 | Su | A63F 9/12 |
| 2019/0082830 | A1 * | 3/2019 | Schaefer | A47B 73/00 |
| 2019/0184272 | A1 * | 6/2019 | Cunningham | A63B 67/06 |
| 2020/0330840 | A1 * | 10/2020 | Francis | A63F 9/0243 |

* cited by examiner

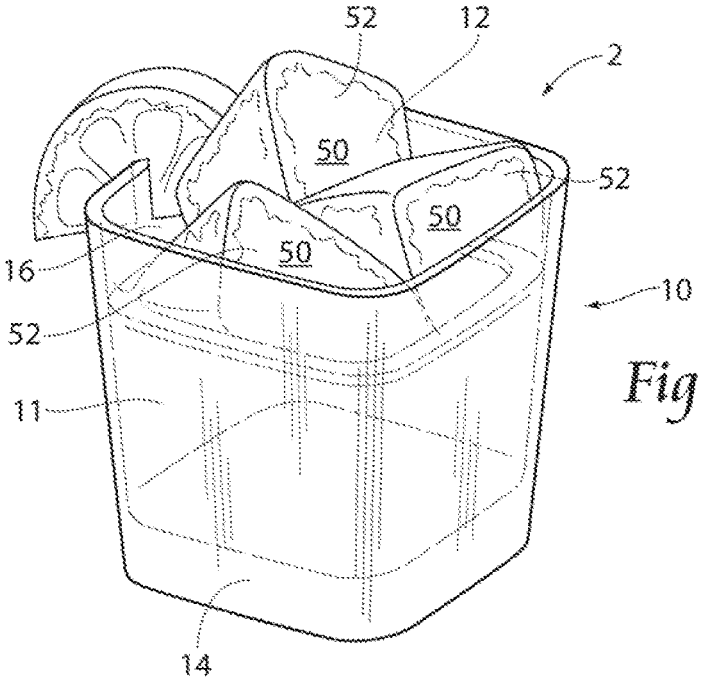
Fig. 1
Fig. 2
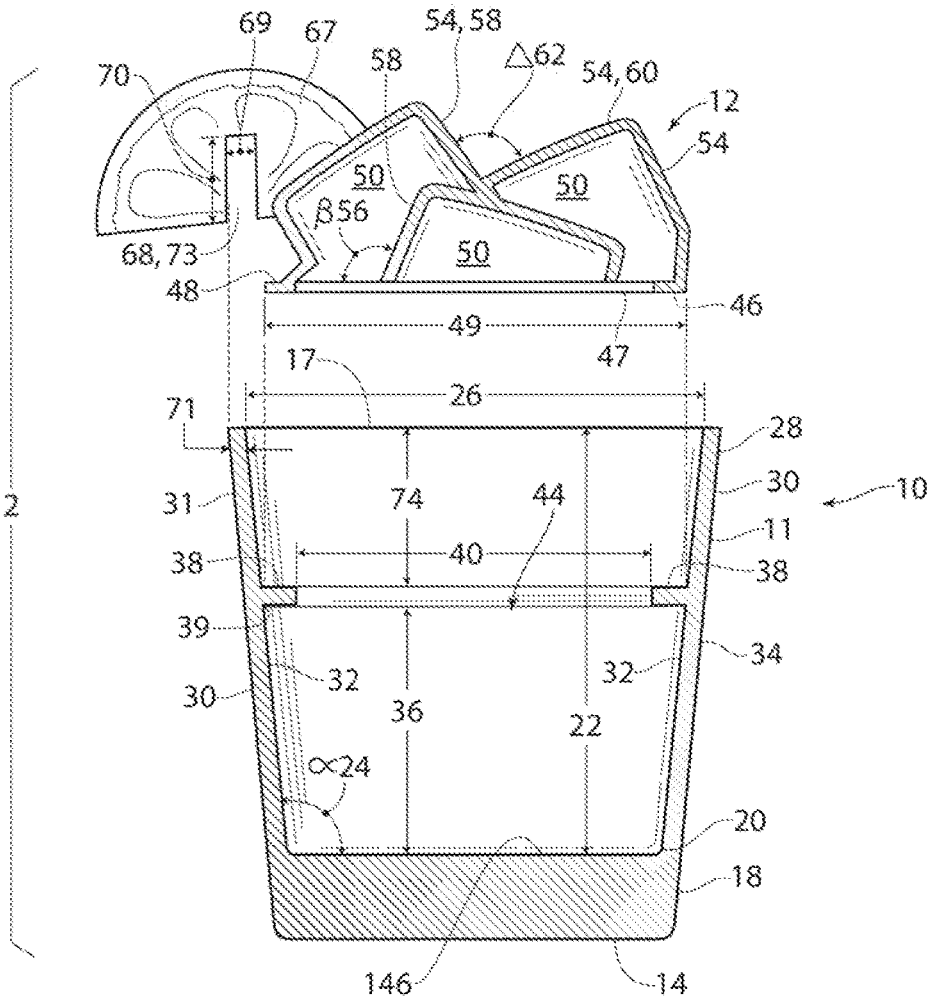

GAME APPARATUS AND METHOD

BACKGROUND OF THE INVENTION

Tossing games have been known and used by consumers for many years. Tossing games have been developed for many uses from entertainment to physical training. These tossing games are typically floor models or table top models.

Typically entertainment indoor tossing games provide for the use of plastic rings, bean bags, rubber balls, ping gong balls or similar objects as the tossing objects. Where these indoor tossing games have the receiving object as a cup or similar object. This receiving cup may provide for a beverage, but does not provide for an angled surface as the resting point for the tossing object. These indoor tossing games typically have an appeal for those above younger ages. Indoor table top tossing games which appeal to the younger ages typically concern tossing an object into or thru a vertically oriented object and not a horizontally oriented object. Finally, these indoor tossing games do not provide illumination so that the tossing game may be operated in low or no light environments.

Outdoor entertainment tossing games provide for many forms of tossing objects. Many of these outdoor tossing games have the receiving object as one or more cups or larger bins. These receiving cups or larger bins may provide for a beverage, but do not provide for an angled surface as the resting point for the tossing object. Where the receiving object provides for angled surfaces the angled surfaces comprise soft or non-rigid materials. Thus, a malleable tossing object would not bounce off the soft or non-rigid material of the prior art receiving object. These outdoor tossing games typically do have an appeal for a wide range of ages. However, the games are designed for a younger age spectrum. None of the outdoor tossing games provide for an adult beverage theme to the entertainment tossing game. Finally, these outdoor tossing games do not provide illumination so that the tossing game may be operated in low or no light environments.

None of these entertainment tossing games are designed with rigid angular surfaces as the resting point for the tossing object. Further, none of these entertainment tossing games provide for illumination to allow for operation of the tossing game in low and no light environments. None of these outdoor tossing games provides for an adult beverage theme to the entertainment tossing game. Finally, none of these entertainment tossing games provide for a method of tossing objects onto a tossing object receiver where the tossing object receiver contains rigid angular surfaces as the resting point for the tossing object.

It is an object of this invention to provide for a tossing game with rigid angular surfaces as the resting point for the tossing object.

It is an object of this invention to provide for illumination to allow for operation of the tossing game in low and no light environments.

It is an object of this invention to provide for outdoor tossing games having an adult beverage theme to the entertainment tossing game.

It is an object of this invention to provide for a method of tossing objects onto a tossing object receiver where the tossing object receiver contains rigid angular surfaces as the resting point for the tossing object.

SUMMARY OF THE INVENTION

The present invention is directed to an apparatus for throwing a tossing object into a container, comprising: the container and at least one tossing object in removable communication; the container having at least one wall and a container base in fixed communication, defining a volume; the volume having an open end and a volume base, wherein the volume base is opposite the open end; the container base is proximate to the volume base; the container providing for removable communication with an insert, wherein the insert is removably retained in the volume on at least one shelf, attached to the at least one wall; and at least one tossing object having dimensions providing for insertion of the at least one tossing object into the volume through the open end.

The apparatus may further comprise at least one surface embellishment provided on the at least one wall. The apparatus may further comprise the insert having at least one geometric object extending from a second face. The apparatus may further comprise the at least one geometric object providing for a first angle. The apparatus may further comprise a first at least one geometric object in communication with a second at least one geometric object and providing for a second angle. The apparatus may further have the insert comprising a rigid material.

The at least one tossing object may comprise a malleable material. The at least one tossing object may comprise a sphere and shaft in communication, wherein the shaft has at least one of a first color and a second color. The at least one tossing object may comprise a spheroid of a third color. The spheroid may have a first end with a circle of a fourth color. The at least one tossing object may have at least one of a cherry theme and an olive theme. The container may have at least one of a tumbler theme and a martini glass theme. The apparatus may have an adult beverage theme. The at least one shelf may be in communication with a second face of the at least one wall.

The present invention is also directed to a method of operating an apparatus for throwing a tossing object into a container, comprising: placing the container at a location; holding at least one tossing object; an operator positioning a distance from the container; and advancing the at least one tossing object in a direction of the container. The method may further comprise placing an insert in communication with the container. The method may further comprise holding the at least one tossing object by at least one of a spherical body and a spheroid body. The method may further comprise advancing the at least one tossing object towards the container in a palming action. The method may further comprise holding the at least one tossing object by a shaft. The method may further comprise advancing the at least one tossing object towards the container in a rotational action.

An intended benefit of this invention is to provide for a tossing name with rigid angular surfaces as the resting point for the tossing object.

An intended benefit of this invention is to provide for illumination to allow for operation of the tossing game in low and no light environments.

An intended benefit of this invention is to provide for outdoor tossing games having an adult beverage theme to the entertainment tossing game.

An intended benefit of this invention is to provide for a method of tossing objects onto a tossing object receiver where the tossing object receiver contains rigid angular surfaces as the resting point for the tossing object.

BRIEF DESCRIPTION OF THE DRAWINGS

FIG. 1 is a perspective view of a first embodiment of the game apparatus invention comprising a container first embodiment and a container insert first embodiment.

FIG. 2 is an exploded cross-section of the first embodiment of the game apparatus invention comprising the container first embodiment and the container insert embodiment.

DESCRIPTION OF THE PREFERRED EMBODIMENT

Figure 3:
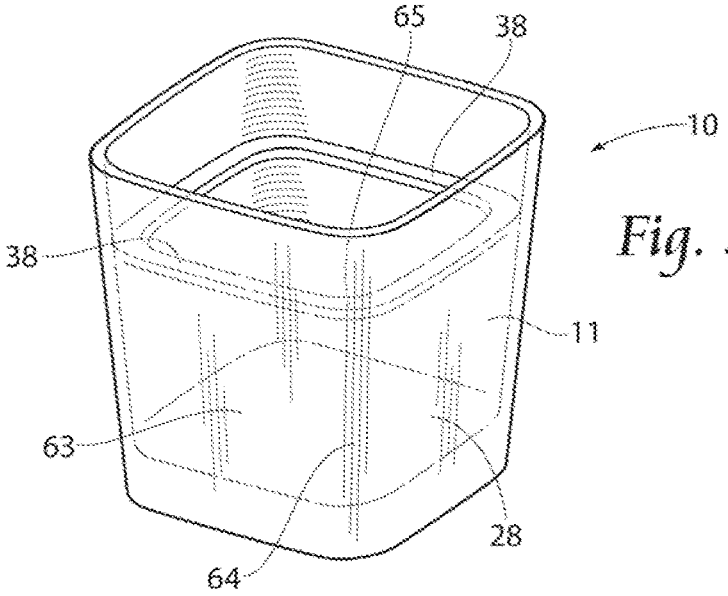
FIG. 3 is a perspective view of the first embodiment of the game apparatus invention comprising the container first embodiment.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

The invention is directed to a game apparatus and methods for use of the game apparatus. With attention to FIGS. 1 thru 6, a first embodiment of the game apparatus 2 is described. The first embodiment, of the game apparatus 2 comprises a container first embodiment 10 in removable communication with a container insert first embodiment 12, and a tossing object first embodiment 42. The container first embodiment 10 comprises a plurality of walls 11 and a container base first embodiment 14, wherein the walls 11 are interconnected. The plurality of walls are further connected to the container base 14, such that the communication of the plurality of walls 11 and the container base 14 defines a volume 16 and wherein the container first embodiment 10 is a tumbler. The container insert first embodiment 12 is in removable communication with the container first embodiment 10, tumbler, within the volume 16 of the container first embodiment 10, tumbler. It is observed the container first embodiment 10, tumbler, is preferably comprised of a polymer. Alternatively, the container first embodiment 10, tumbler, may be comprised of a metal or fiber material. It is observed the container insert first embodiment 12 is preferably comprised of a rigid material such as a rigid polymer. Alternatively, the container first embodiment 10, tumbler, may be comprised of a metal.

As illustrated in FIG. 2, an exploded cross-section of the first embodiment of the game apparatus invention comprising the container first embodiment 10 and the container insert first embodiment 12, a wall first end 20 of the plurality of walls 11 connect to the container base 14 about a base perimeter 18 From the container base 14, the plurality of walls 11 extends a wall height 22 to a container first embodiment open end 17, and defining the volume 16. The plurality of walls 11 extend from the container base 14 at an angle ($\alpha$) 24, providing for increasing of a wall separation distance 26 between a first wall 28 and an oppositely opposed second wall 31 along the wall height 22 from the container base 14 to the container first embodiment open end 17. The relationship between the plurality of walls 11 and the container base 14 creates the tumbler appearance of the container first embodiment 10.

Figure 5:
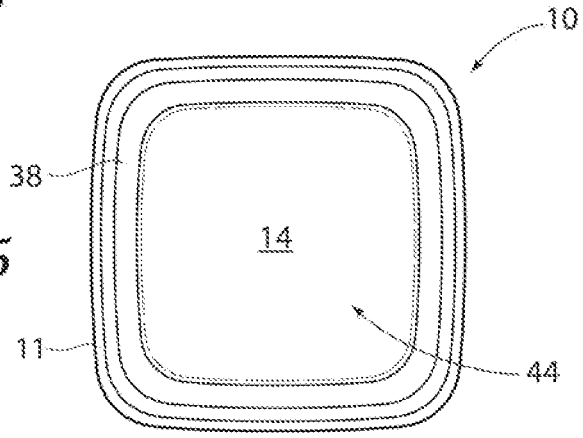
FIG. 5 is a top view of the first embodiment of the game apparatus invention comprising the container first embodiment.

Each wall (28, 30) of the plurality of walls 11 has a first face 30 and a second face 32. The first face 30 defines an outer wall perimeter 34 of the container first embodiment 10. The second face 32 is oppositely opposed to the first face 30 and defines the volume 16 of the container first embodiment 10. At a second wall height 36 an insert shelf first embodiment 38 extends from the second face 32 of each wall (28, 30) of the plurality of walls 11. The insert shelf 38 substantially maintains a position 39 at the second wall height 36 along each of the walls (28, 30) of the plurality of walls 11. The insert shelf 38 extends from the second face 32 into the volume 16 such that a shelf separation distance 40 exists between insert shelves 38 of oppositely opposed walls (28, 30) to define a shelf opening 44. Wherein, as illustrated in FIG. 5, an operator may insert the tossing object first embodiment 42 into the container first embodiment open end 17, into the volume 16, and thru the shelf opening 44 such that the tossing object first embodiment 42 may land on the container base 14, or volume base 146.

The container insert first embodiment 12 comprises an insert base 46 haring a first base face 47 and a second base face 48. As seen in FIG. 1, the insert base 46 having dimensional characteristics which allow the base to be inserted into the container first embodiment open end 17 and reside on the insert shelf 38. Specifically, the base length 49 is preferably less than the wall separation distance 26 and greater than the shelf separation distance 40. Thus, when the container insert first embodiment 12 is inserted into the volume 16 the first base face 47 is in removable communication with the insert shelf 38. Extending from the second base face 48 is at least one geometric object 50, and preferable three geometric objects 50, wherein the at least one geometric object 50 represent at least one ice cube. Each geometric object 50 having a cubic shape 52, as seen in FIG. 1. Wherein the geometric objects 50 are positioned in relation to the second base face 48 such that an angle (β) 56 exists between each face 54 of the geometric objects 50 and the second face base 48. Wherein the angle (β) 56 between any individual face 58 and the second base face 48 is preferably different the angle (β) 56 between any second individual face 60 and the second base face 48. Further, the relationships between the any individual face 58 and the any second individual face 60 preferably creates an at least one angle (Δ) 62. The at least one angle (β) 56 and the least one angle (Δ) 62 provided for challenging surface relationships for which an operator needs to consider when throwing the tossing object first embodiment 42 at the first embodiment of the game apparatus 2 with the intention of settling the tossing object first embodiment 42 among the at least one geometric object 50 when the container insert first embodiment 12 is employed. An intended benefit of this invention is to provide for a tossing game with rigid angular surfaces as the resting point for the tossing object.

A hemispherical body 67 extends from at least one of the geometric objects 50, such the hemispherical body 67 is positioned at least in part outside of the insert base 46 as defined by the base length 49. The hemispherical body 67 has the appearance of a wedge and is intended to have the appearance of a wedge of fruit or vegetable which one would place in a beverage. The hemispherical body 67 preferably has a notch 68 having an opening 73 in the direction of the insert base 46. The notch extending a notch distance 70 and having a notch width 69. Wherein the notch width 69 is preferably greater than the face distance 71 between the first face 30 and the second face 32 of any one of the plurality of walls 11. Such that when the container insert first embodiment 12 is placed into the container first embodiment open end 17, the notch 68 receives any one of the plurality of walls 11. The notch distance 70 is equal or greater than an opening to shelf distance first embodiment 74 traveled by the insert base 46 to the insert shelf 38 when the insert base 46 is placed into the container first embodiment open end 17.

As illustrated in FIG. 3, the first wall 28 and an adjacent wall 63 are connected at a rounded corner 64. Further the insert shelf 38 of the first wall 28 and the insert shelf 38 of the adjacent wall 63 are connected at a rounded insert connection 65. The relationship between the first wall 28 and the adjacent wall 63, as illustrated in FIG. 3, is continued for all interconnecting walls of the plurality of walls 11. The relationship between file insert shelf 38 of the first wall 28 and the insert shelf 38 of the adjacent wall 63, as illustrated in FIG. 3, is continued for all interconnecting insert shelves 38 of the plurality of walls 11.

Figure 4A:
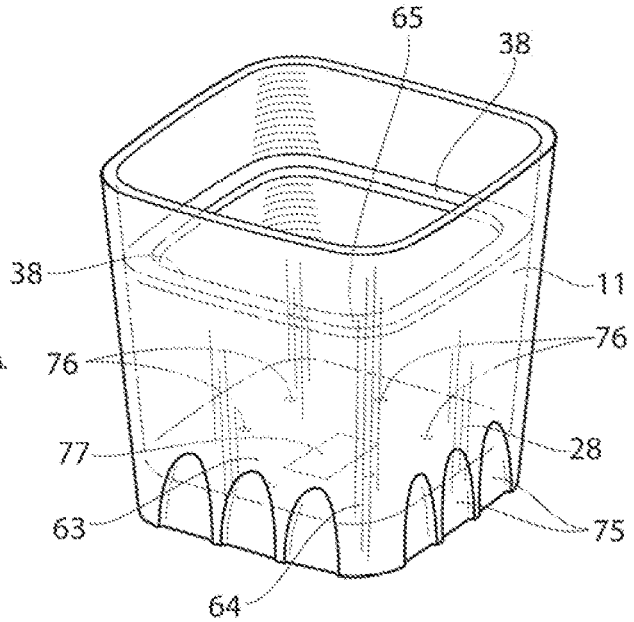
FIG. 4A is a perspective view of the first embodiment of the game apparatus invention comprising the container first embodiment with surface embellishments.

As illustrated in FIG. 4A, at least one surface embellishment 75 is formed on the container insert first embodiment 12 to give the appearance of a tumbler. Further, the container insert first embodiment 12 preferably incorporates at least one illumination source 76. The at least one illumination source 76 is preferably housed within the container base 14, wherein the at least one illumination source 76 provides light into the volume 16. The at least one illumination source 76 is powered by a remote battery 77 housed in the container base 14. Preferably, the remote battery 77 is in removable communication with the container base 14. The at least one illumination source 76 is preferably an LED. An intended benefit of this invention is to provide for illumination to allow for operation of the tossing game in low and no light environments. Alternatively, as illustrated in FIG. 4C, the container 10 may lack at least one of the at least one illumination source 76 and the remote battery.

Figure 4B:
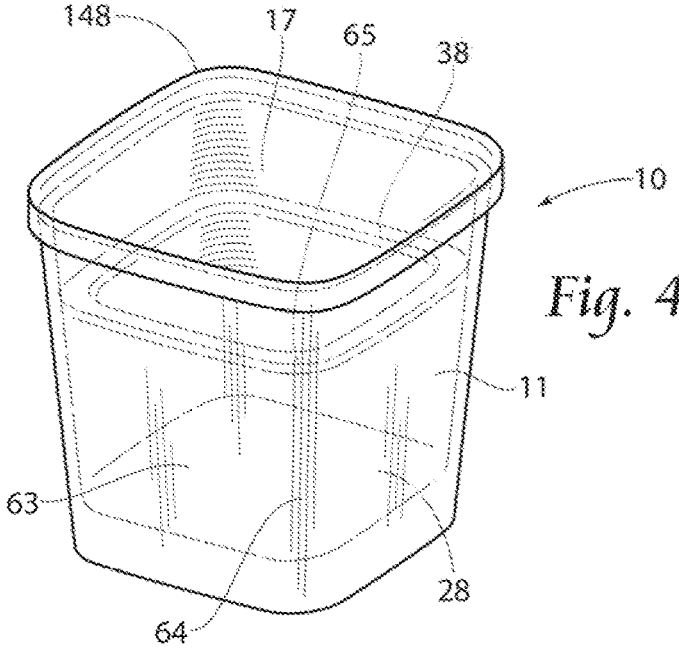
FIG. 4B is a perspective view of the first embodiment of the game apparatus invention comprising the container first embodiment having a container top first embodiment.
Figure 4C:
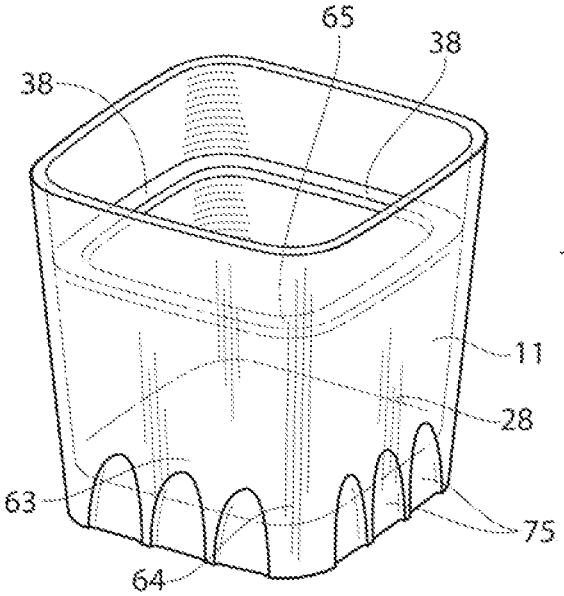
FIG. 4C is a perspective view of the first embodiment of the game apparatus invention comprising the container first embodiment.

As illustrated in FIG. 4B, a container top first embodiment 148 is illustrated in removable communication with the container 10, wherein the container top 148 covers the container open end 17 when the container too 148 is in removable communication with the container 10. When applied, the container top 148 and container 10 provide volume 16 for storage of at least one tossing object first embodiment 42 (reference FIG. 6).

Figure 6:
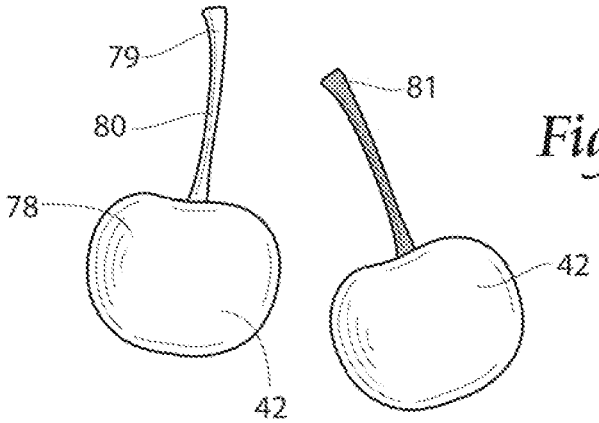
FIG. 6 are side views of two separately marked objects each comprising a tossing object for a first embodiment of the invention.

With attention to FIG. 6, the tossing object first embodiment 42 is illustrated. The tossing object first embodiment 42 comprises a spherical body 78 with a shaft 79 extending from the spherical body 78, such the tossing object 42 represents a cherry used in beverages. A specified number of the tossing object first embodiments 42 preferably have a shaft of a first color 80, for example white, and an equal or substantially equal number of tossing object first embodiments 42 shall have a shaft of a second contrasting color 81, for example black, in any particular game of the first embodiment of the game apparatus 2 in order for operators 90 to identify their tossing objects 42. The tossing object 42 preferably is malleable. The tossing object 42 preferably is an inflatable object. The tossing object 42 alternatively may comprise a polymer shell which is filled with a polymer based foam. The tossing object 42 alternatively may comprise a cloth shell with a granular filler material, for example a bean bag. The interaction of the rigid container insert 12 and the malleable tossing object 42 provides for increased difficulty in resting the tossing object 42 on the container insert 12 when the tossing object 42 is thrown at the container insert 42 by an operator 90.

Figure 7A:
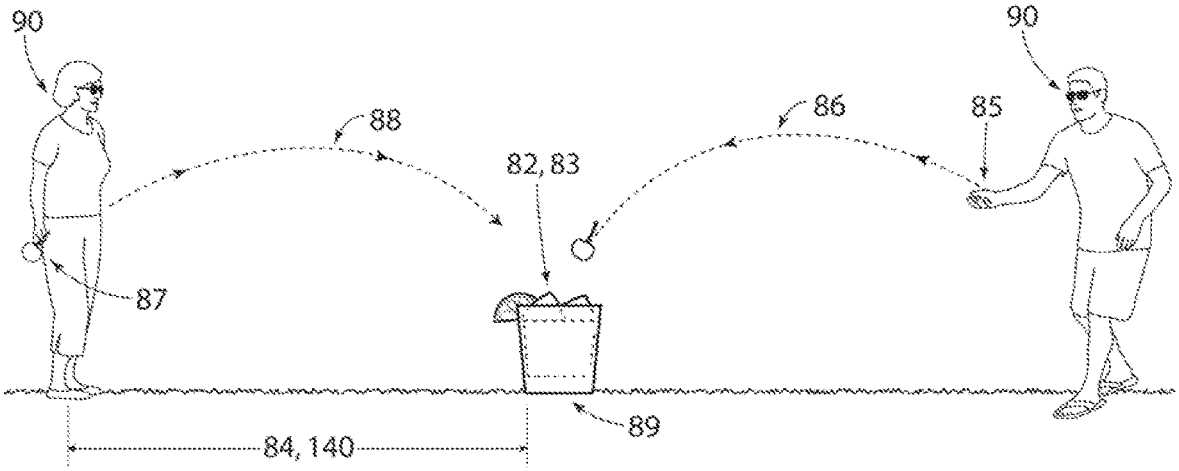
FIG. 7A is a method of using the first embodiment of the game apparatus invention as applied on a ground surface.
Figure 7B:
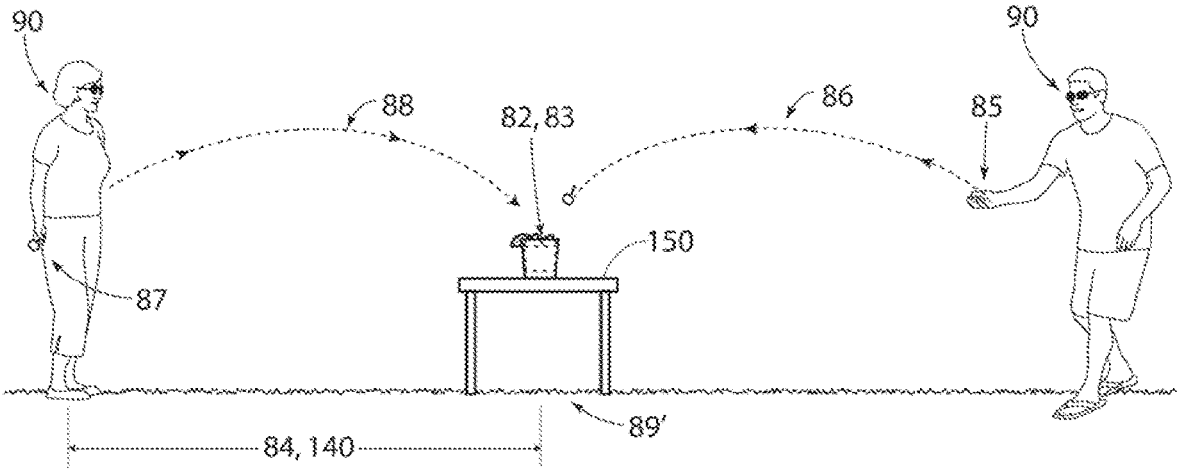
FIG. 7B is the method of using the first embodiment of the game apparatus invention as applied on at least one of a tabletop and a raised surface.
Figure 8:
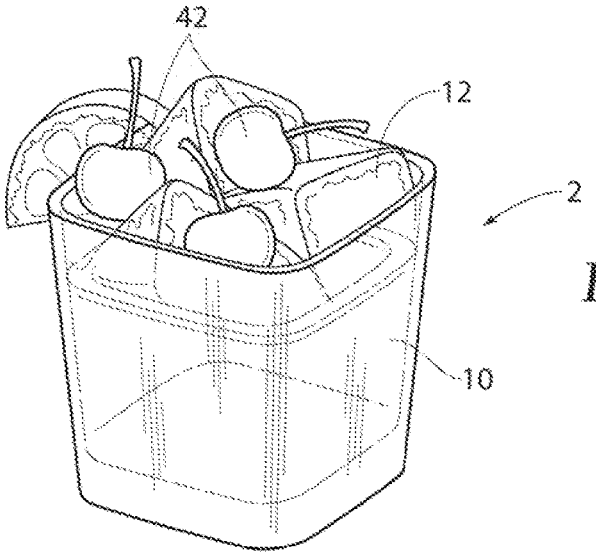
FIG. 8 is a perspective view of the first embodiment of the game apparatus invention comprising the container first embodiment and the container insert first embodiment with the tossing object first embodiment of the invention.

With attention to FIGS. 7A, 7B and 8, a method of operating the first embodiment of the game apparatus is illustrated. As illustrated in FIG. 7A, the container first embodiment 10 is placed in a location 89, 82. Wherein the location 89 is a ground surface such as at least one of a hard wood surface, carpeting, base flooring, outdoor surface, outdoor ground, grass, pavement, concrete, and pavers. The container insert first embodiment 12 is placed in communication with the container first embodiment 10, 83. Alternatively, the container first insert embodiment 12 is not employed. The operator 90 positions a distance 140 from the container 10, 84. The operator 90 holds the tossing object first embodiment 42, the cherry, by the spherical body 78, 85. The operator 90 tosses the tossing object first embodiment 42 towards the container first embodiment 10 in a palming action, 86. Alternatively, the operator holds the tossing object first embodiment 42 by the shaft 79, 87. The operator 90 tosses the tossing object first embodiment 42 towards the container first embodiment 10 in rotational action, 88. As illustrated in FIG. 7B, the method of operating the first embodiment of the game apparatus 2 may provide for a location second embodiment 89', wherein the location 89' is at least one of a tabletop and a raised surface 150. The method as illustrated in FIG. 7B is the same as that illustrated in FIG. 7A. When employing the method of operating the first embodiment of the game apparatus 2 on a tabletop, it is observed the container 10, insert 12, and at least one tossing object first embodiment 42 may be of a size suitable for tabletop game seas which require dimensions for at least one a tabletop or a raised surface 150. While when employing the method of operating the first embodiment of the game apparatus 2 on a ground surface location 89, it is observed the container 10, insert 12, and at least one tossing object first embodiment 42 may be of a size suitable for ground surface game sets which require dimensions greater than that for the container 10, insert 12, and at least one tossing object first embodiment 42 when applied on at least one a tabletop or a raised surface 150. As illustrated in FIG. 8, where the container insert first embodiment 12 is employed, a successful outcome of the toss (86, 88) provides for the tossing object first embodiment 42 residing upon an in removable communication with the geometric objects. An intended benefit of this invention is to provide for a method of tossing objects onto a tossing object receiver where the tossing object receiver contains rigid angular surfaces as the resting point for the tossing object.

As previously noted, it is observed the first embodiment of the game apparatus 2 may provide for at least one including the insert 12 and not including the 12 during operation of the first embodiment of the game apparatus 2.

Figure 9A:
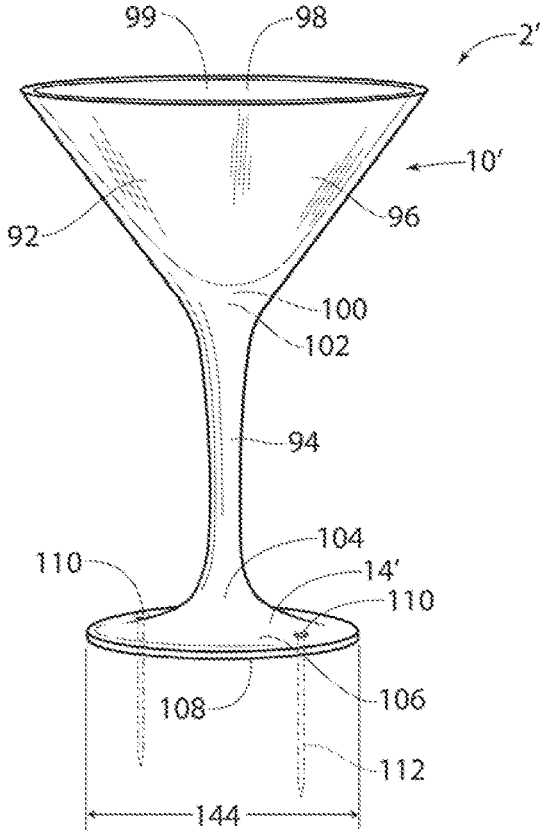
FIG. 9A is a side view of a second embodiment of the game apparatus invention comprising a container second embodiment.

With attention FIGS. 9A to 11, a second embodiment of the game apparatus 2' is illustrated. The second embodiment of the game apparatus 2' comprises at least one of a container second embodiment 10' and a container third embodiment 10", container insert second embodiment 12', and a tossing object second embodiment 42'. As illustrated in FIG. 9A, the container 10' comprises a conical receiver first embodiment 92, stem 94 and a container base second embodiment 14'. The conical receiver 92 comprises a conical wall first embodiment 96 which defines a conical volume first embodiment 98. Wherein the conical wall 96 provides the conical volume 98 for receiving the tossing object 42' thru a container open end first embodiment 99 of the apparatus second embodiment 2'. A second end first embodiment 100 of the conical receiver 92 is opposite the container open end 99 and defines a base of the conical receiver 92. The second end 100 of the conical receiver 92 is in fixed communication with the stem 94 at a stem first end 102. A stem second end 104, opposite the stem first end 102, is in fixed communication with the container base 14', specifically a base second embodiment first side 106. The container base 14' comprises the base second embodiment first side 106 and an oppositely opposed base second embodiment second side 108. At least two through holes 110 extend from the base second embodiment first side 106 and through the oppositely opposed base second embodiment second side 108. Wherein anchors 112 can be inserted into the at least two through holes 110 to provide stability for the container 10' during operation. The container base 14' preferably has a diameter 144 providing for stability of the container 2'.

Figure 9B:
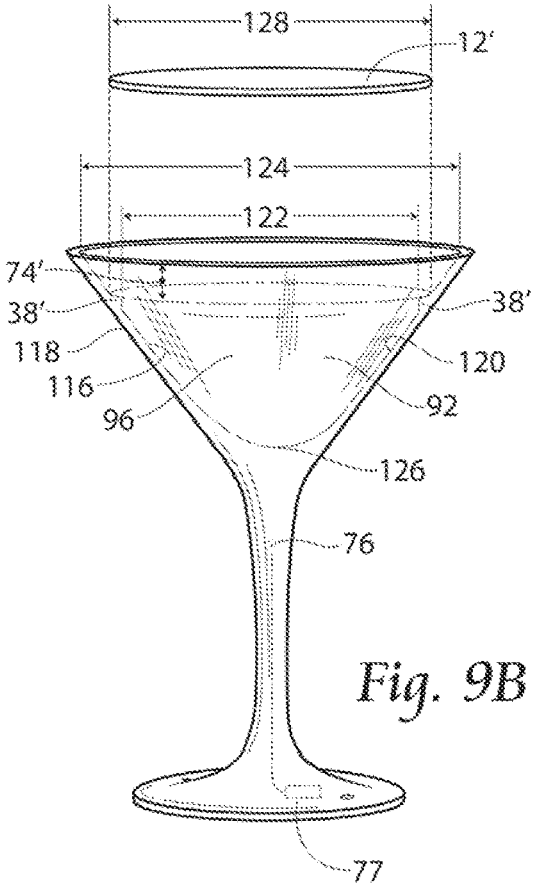
FIG. 9B is a side view of the second embodiment of the game apparatus invention comprising the container second embodiment and a container insert second embodiment.

As illustrated in FIG. 9B, the conical wall 96 comprises a conical wall first face first embodiment 118 and a conical wall second face first embodiment 116, wherein the conical wall first face 118 defines the conical receiver 92. The conical wall second face 116 defines the conical volume 98. An insert shelf second embodiment 38' extends from the second face 116 at least substantially around the second face circumference first embodiment 120 at an opening to shelf distance second embodiment 74' from the container open end 99. The insert shelf 38' extends into the conical volume 98 such that the insert shelf 38' provides for an inner shell diameter first embodiment 122. Further, the container open end 99 has an opening diameter first embodiment 124. Such that the inner shelf diameter 122 and the opening diameter 124 allow for the tossing object 42' to enter the container open end 99, pass through inner shelf diameter 122 and rest at a conical volume base first embodiment 126.

The container insert 12' has dimensional characteristics which allow the container insert 12' to be inserted into the container open end 99 and reside on the insert shelf 38'. Specifically, an insert diameter 128 is preferably less than the opening diameter 124 and greater than the inner shelf diameter 122. Thus, when the container insert 12' is inserted into the conical volume 98 the container insert 12' is in removable communication with the insert shelf 38'.

The container 10' preferably incorporates at least one illumination source 76. The at least one illumination source 76 is preferably housed within the stem 94, wherein the at least one illumination source 76 provides light into the conical volume 98. The at least one illumination source 76 is powered by a remote battery 77 housed in the container base 14'. Preferably, the remote battery 77 is in removable communication with the container base 14'. The at least one illumination source 76 is preferably an LED. An intended benefit of this invention is to provide for illumination to allow for operation of the tossing game in low and no light environments. Alternatively, as illustrated in FIG. 9D, the container 10' may lack at least one of the at least one illumination source 76 and the remote battery 77.

Figure 9C:
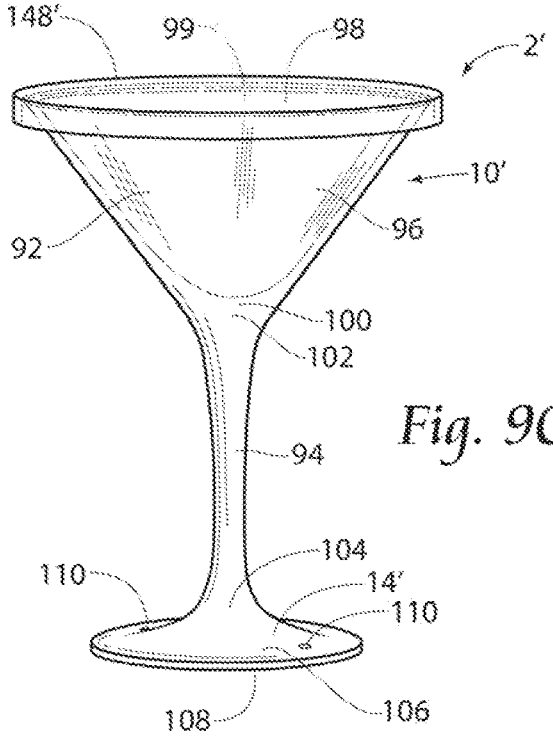
FIG. 9C is a side view of the second embodiment of the game apparatus invention comprising the container second embodiment having a container top second embodiment.
Figure 9D:
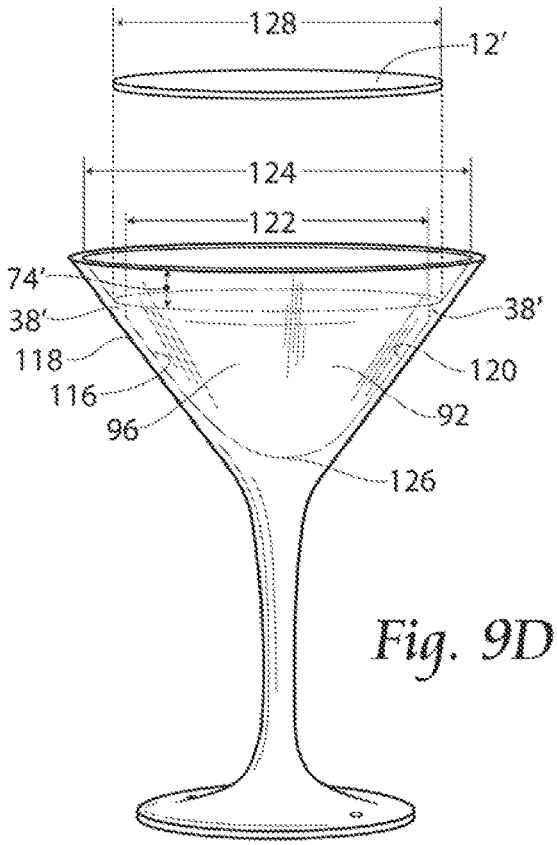
FIG. 9D is a side view of the second embodiment of the game apparatus invention comprising the container second embodiment.

As illustrated in FIG. 9C, a container top second embodiment 148' is illustrated in removable communication with the container 10', wherein the container top 148' covers the container open end 99 when the container top 148' is in removable communication with the container 10'. When applied, the container top 148' and container 10' provide the conical volume first embodiment 98 for storage of at least one tossing object second embodiment 42' (reference FIG. 11).

The second embodiment of the game apparatus 2' comprises a container second embodiment 10', container insert second embodiment 12', a tossing object second embodiment 42', and where applicable a container third embodiment 12".

Figure 10A:
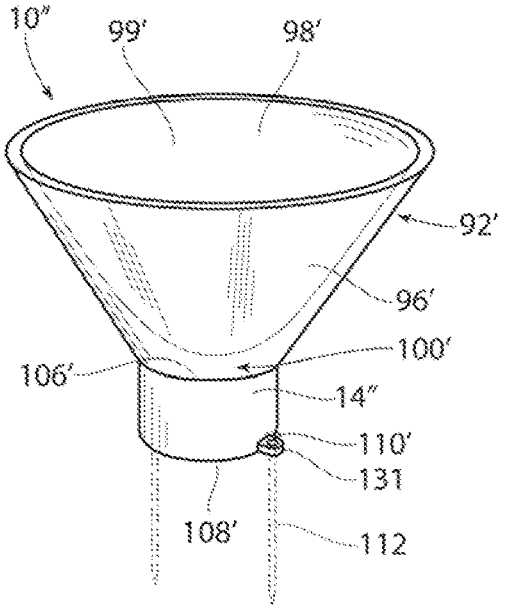
FIG. 10A is a side view of a second embodiment of the game apparatus invention comprising a container third embodiment.
Figure 10B:
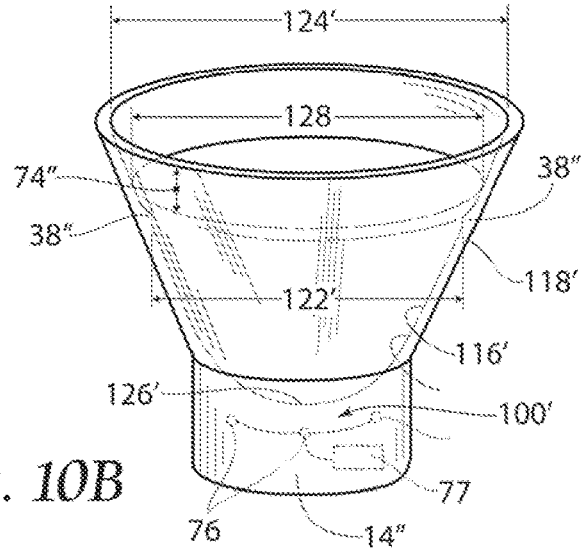
FIG. 10B is a side view of the second embodiment of the game apparatus invention comprising the container third embodiment and a container insert second embodiment.

As illustrated in FIGS. 10A and 10B, the container third embodiment 10" comprises a conical receiver second embodiment 92' and a container base third embodiment 14". The conical receiver 92 comprises a conical wall second embodiment 96' which defines a conical volume second embodiment 98'. Wherein the conical wall 96' provides the conical volume 98' for receiving the tossing object 42' thru a container open end second embodiment 99' of the apparatus second embodiment 2'. A second end second embodiment 100' of the conical receiver 92 is opposite the container open end 99' and defines a base of the conical receiver 92'. The second end 100' of the conical receiver 92' is in fixed communication with the container base 14", specifically a base third embodiment first side 106'. The container base 14" comprises the base first side 106' and an oppositely opposed base third embodiment second side 108'. At least two extensions 131 protrude from the container base 14" in close proximity to oppositely opposed base third embodiment second side 108'. The extensions 131 have at least one through hole second embodiment 110', wherein anchors 112 can be inserted into the at least two through holes 110' to provide stability for the container 10' during operation. The container base 14" preferably provides greater weight to the container 2" than the conical receiver 92 providing for stability of the container 2".

As illustrated in FIG. 10B, the conical wall 96 comprises a conical wall first face second embodiment 118' and a conical wall second face second embodiment 116', wherein the conical wall first face 118' defines the conical receiver 92'. The conical wall second face. 116' defines the conical volume 98'. An insert shelf third embodiment 38" extends from the second face 116' at least substantially around the second face circumference second embodiment 120' at an opening to shelf distance third embodiment 74" from the container open end 99'. The insert shelf 38" extends into the conical volume 98' such that the insert shelf 38" provides for an inner shelf diameter second embodiment 122'. Further, the container open end 99' has an opening diameter second embodiment 124'. Such that the inner shelf diameter 122' and the opening diameter 124' allow for the tossing object 42' to enter the container open end 99', pass through inner shelf diameter 122 and rest at a conical volume base second embodiment 126'.

The container insert 12' has dimensional characteristics which allow the container insert 12' to be inserted into the container open end 99' and reside on the insert shelf 38". Specifically, an insert diameter 128 is preferably less than the opening diameter 124' and greater than the inner shelf diameter 122'. Thus, when the container insert 12' is inserted into the conical volume 98' the container insert 12' is in removable communication with the insert shelf 38".

The container 10" preferably incorporates at least one illumination source 76. The at least one illumination source 76 is preferably housed within the container base 14", wherein the at least one illumination source 76 provides light into the conical volume 98'. The at least one illumination source 76 is powered by a remote battery 77 housed in the container base 14". Preferably, the remote battery 77 is in removable communication with the container base 14". The at least one illumination source 76 is preferably an LED. An intended benefit of this invention is to provide for illumination to allow for operation of the tossing game in low and no light environments. Alternatively, as illustrated in FIG. 10D, the container 10" may lack at least one of the at least one illumination source 76 and the remote battery 77.

Figure 10C:
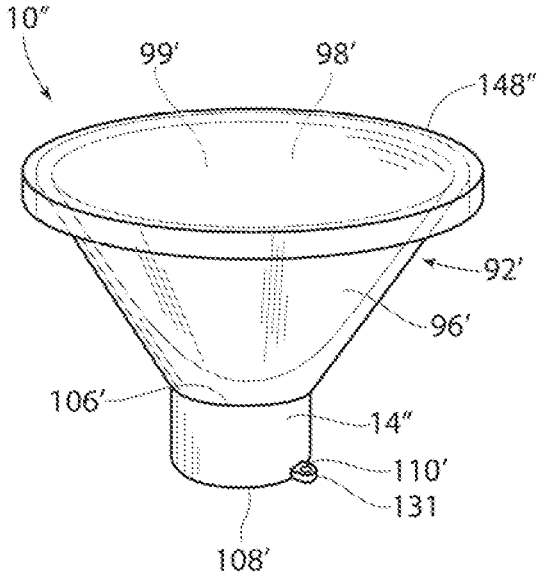
FIG. 10C is a side view of the second embodiment of the game apparatus invention comprising the container third embodiment having a container top third embodiment.
Figure 10D:
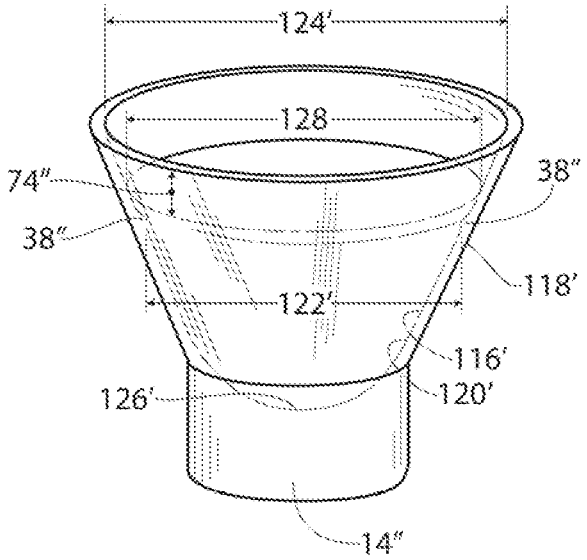
FIG. 10D is a side view of the second embodiment of the game apparatus invention comprising the container third embodiment.

As illustrated in FIG. 10C, a container top third embodiment 148" is illustrated in removable communication with the container 10", wherein the container top 148" covers the container open end 99' when the container top 148" is in removable communication with the container 10". When applied, the container top 148" and container 10" provide the conical volume second embodiment 98' for storage of at least one tossing object second embodiment 42' (reference FIG. 11).

Figure 11:
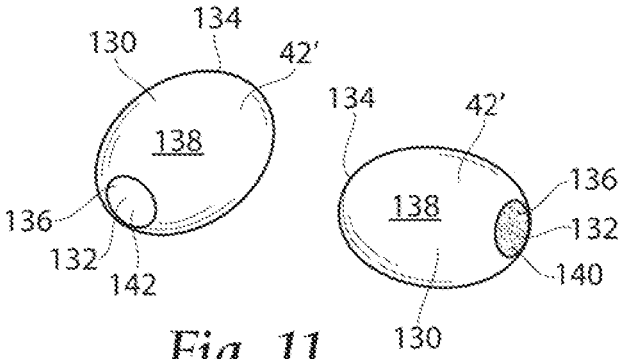
FIG. 11 are side views of two separately marked objects each comprising a tossing object for a second embodiment of the invention.
Figure 12A:
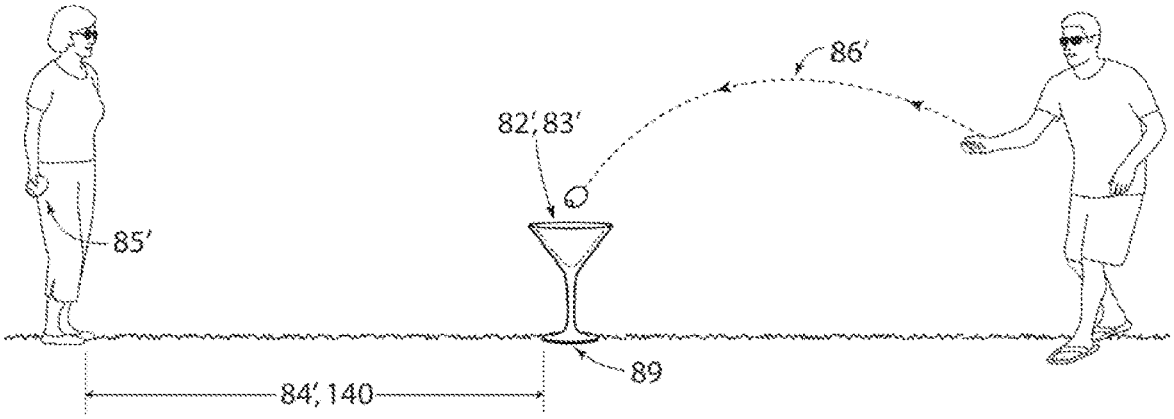
FIG. 12A is a method of using the second embodiment of the game apparatus invention applying the container second embodiment as applied on a ground surface.
Figure 12B:
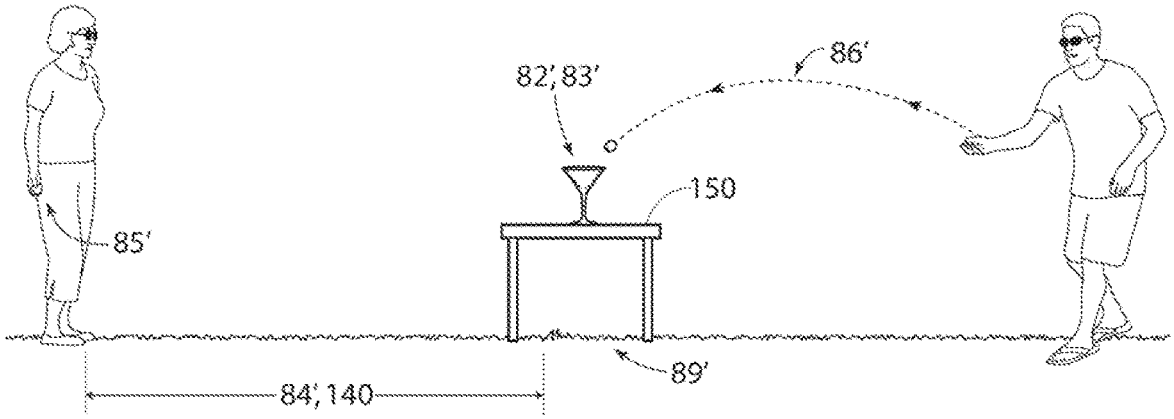
FIG. 12B is the method of using the second embodiment of the game apparatus invention applying the container second embodiment as applied on at least one of a tabletop and a raised surface.

With attention to FIG. 11, the tossing object second embodiment 42' is illustrated. The tossing object 42' comprises a spheroid body 130 having a first spheroid end 132 and an oppositely opposed second spheroid end 134. Where the spheroid body 130 is a third color 138. The first spheroid end 132 having a circular area 136 of at least one of a fourth color 140, for example blue, and a fifth color 142, for example red. Wherein, a specified number of the tossing objects 42' preferably have circular area 136 of the fourth color 140, for example blue, and an equal or substantially equal number of tossing objects 42' shall have circular area 136 of the fifth color 142, for example red, in any particular game of the first embodiment of the game apparatus 2 in order for operators 90 to identify their tossing objects 42'. The tossing object 42' represents an olive, i.e. spheroid body 130, having a pimento or other filler material, i.e. circular area 136. An intended of this invention is to provide for outdoor tossing games having an adult beverage theme to the entertainment tossing game. The tossing object 42' preferably is malleable. The tossing object 42' preferably is an inflatable object. The tossing object 42' alternatively may comprise a polymer shell which is filled with a polymer based foam. The tossing object 42' alternatively may comprise a cloth shell with a granular filler material, for example a bean bag.

Figure 13:
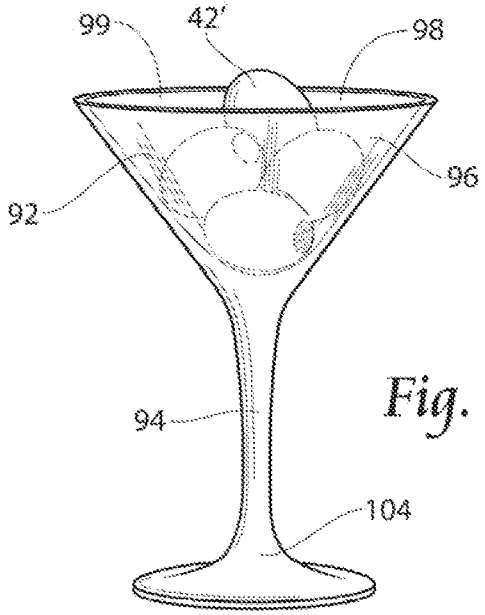
FIG. 13 is a side view of the second embodiment of the game apparatus invention comprising the container second embodiment with the tossing object second embodiment of the invention.

With attention to FIGS. 12 to 15, a method of operating the second embodiment of the game apparatus 2' is illustrated. As illustrated in FIG. 12A, the container second embodiment 10' is placed in a location 89, 82'. Wherein the location 89 is a ground surface such as at least one of a hard wood surface, carpeting, base flooring, outdoor surface, outdoor ground, grass, pavement, concrete, and pavers. The container insert second embodiment 12' is placed in communication with the container 10', 83'. Alternatively, the container insert 12' is not employed. The operator positions a distance 140 from the container 10', 84'. The operator 90 holds the tossing object 42', the olive, by the spheroid body 130, 85'. The operator 90 tosses the tossing object 42' towards the container 10' in a palming action, 86'. As illustrated in FIG. 12B, the method of operating the second embodiment of the game apparatus 2', applying the container second embodiment 10', may provide for a location second embodiment 89', wherein the location 89' is at least one of a tabletop and a raised surface 150. The method as illustrated in FIG. 12B is the same as that illustrated in FIG. 12A. When employing the method of operating the second embodiment of the game apparatus 2' on a tabletop, it is observed the container 10', insert 12', and at least one tossing object second embodiment 42' may be of a size suitable for tabletop game sets which require dimensions for at least one a tabletop or a raised surface 150. While when employing the method of operating the second embodiment of the game apparatus 2' on a ground surface location 89, it is observed the container 10', insert 12', and at least one tossing object second embodiment 42' may be of a size suitable for ground surface game sets which require dimensions greater than that for the container 10', insert 12', and at least one tossing object second embodiment 42' when applied on at least one a tabletop or a raised surface 150. As illustrated in FIG. 13, a successful outcome of the toss 86' provides for the tossing object 42' residing in the conical volume 98.

Figure 14A:
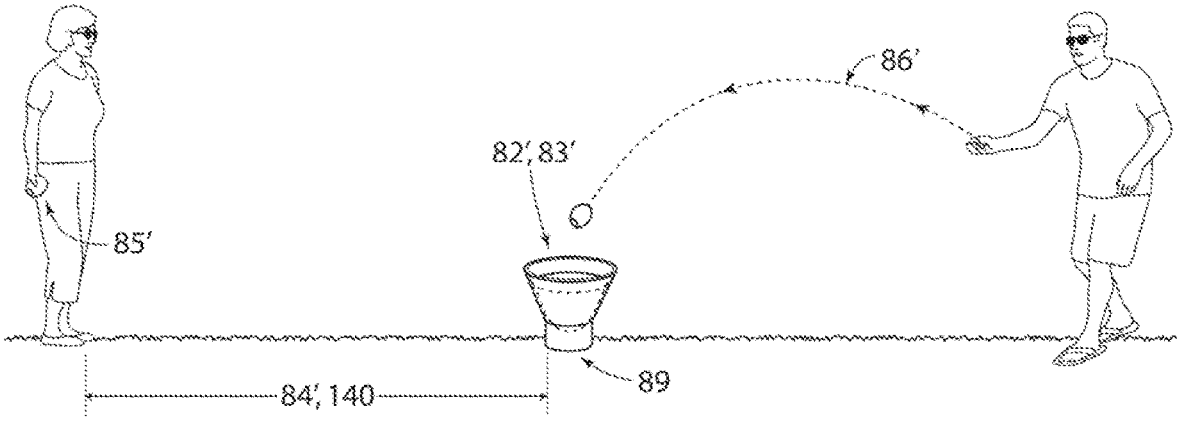
FIG. 14A is the method of using the second embodiment of the game apparatus invention applying the container third embodiment as applied on a ground surface.
Figure 14B:
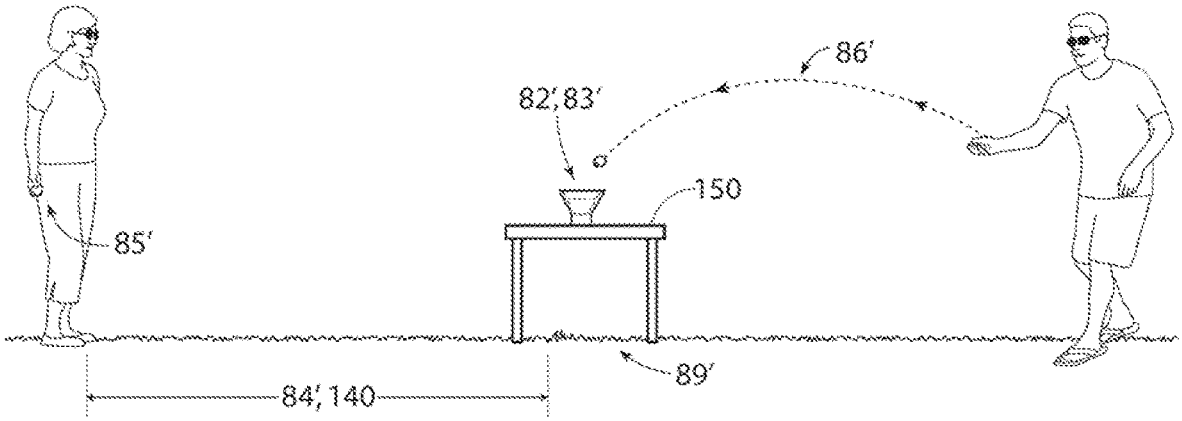
FIG. 14B is the method of using the second embodiment of the game apparatus invention applying the container third embodiment as applied on at least one of a tabletop and a raised surface.
Figure 15:
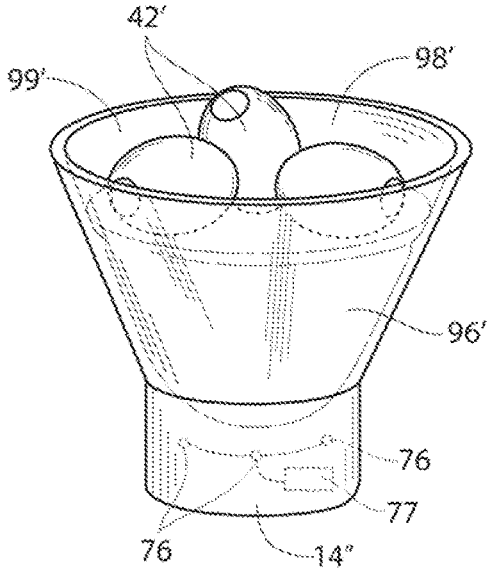
FIG. 15 is a side view of the second embodiment of the game apparatus invention comprising the container third embodiment with the tossing object second embodiment of the invention.

As illustrated in FIG. 14A, the container third embodiment 10" is placed in a location 89, 82'. Wherein the location 89 is a ground surface such as at least one of a hard wood surface, carpeting, base flooring, outdoor surface, outdoor ground, grass, pavement, concrete, and pavers. The container insert second embodiment 12' is placed in communication with the container 10', 83'. Alternatively, the container insert 12' is not employed. The operator positions a distance 140 from the container 10", 84'. The operator 90 holds the tossing object 42', the olive, by the spheroid body 130, 85'. The operator 90 tosses the tossing object 42' towards the container 10" in a palming action, 86'. As illustrated in FIG. 14B, the method of operating the second embodiment of the game apparatus 2', applying the container third embodiment 10", may provide for a location second embodiment 89', wherein the location 89' is at least one of a tabletop and a raised surface 150. The method as illustrated in FIG. 14B is the same as that illustrated in FIG. 14A. When employing the method of operating the second embodiment of the game apparatus 2' on a tabletop, it is observed the container 10", insert 12', and at least one tossing object second embodiment 42' may be of a size suitable for tabletop game sets which require dimensions for at least one a tabletop or a raised surface 150. While when employing the method of operating the second embodiment of the game apparatus 2' on a ground surface location 89, it is observed the container 10", insert 12', and at least one tossing object second embodiment 42' may be of a size suitable for ground surface game sets which require dimensions greater than that for the container 10", insert 12', and at least one tossing object second embodiment 42' when applied on at least one a tabletop or a raised surface 150. As illustrated in FIG. 15, a successful outcome of the toss 86' provides for the tossing object 42' residing in the conical volume 98'. An intended benefit of this invention is to provide for a method of tossing objects onto a tossing object receiver where the tossing object receiver contains rigid angular surfaces as the resting point for the tossing object.

As previously noted, it is observed the second embodiment of the game apparatus 2' may provide for at least one including the insert 12' and not including the 12' during operation of the second embodiment of the game apparatus 2'.

At least one feature of the first embodiment of the game apparatus 2 may be combined with at least one feature of the second embodiment of the game apparatus 2'.

At least one feature of the method of operating the first embodiment of the game apparatus 2 may be combined with at least one feature of the method of operating the second embodiment of the game apparatus 2'.

At least one feature of the first embodiment of the game apparatus 2 may be combined with at least one feature of the method of operating the second embodiment of the game apparatus 2'.

At least one feature of the second embodiment of the game apparatus 2' may be combined with at least one feature of the method of operating the first embodiment of the game apparatus 2.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. An apparatus for throwing a tossing object into a container, comprising:

said container and at least one tossing object in removable communication;

said container having at least one wall and a container base in fixed communication, defining a volume;

said volume having an open end with said container base opposite said open end;

an insert in detachable communication with said container, within said volume and on at least one shelf, said at least one shelf attached to said at least one wall;

said insert having an insert base, with said insert base resting on said at least one shelf;

first and second adjacent interconnected cubic objects affixed to said insert base, positioned towards said open end, and separated by a first angle defined by said interconnection;

said interconnection further defining a resting point within said first angle; and said at least one tossing object having a spherical body and a spheroid body having a dimension insertable into said first angle and removably positioned upon said point.

2. The apparatus of claim 1, further comprising at least one surface embellishment provided on said at least one wall.

3. The apparatus of claim 1, further comprising a second angle defined by an intersection of at least one of said first and said second interconnected cubic objects and said insert base.

4. The apparatus of claim 1, wherein said insert comprising a rigid material.

5. The apparatus of claim 1, wherein said at least one tossing object comprising a malleable material.

6. The apparatus of claim 1, wherein said at least one tossing object comprises said spherical body a shaft in communication with said spherical body wherein said shaft having at least one of a first color and a second color.

7. The apparatus of claim 1, wherein said at least one tossing object comprising said spherical body of a third color.

8. The apparatus of claim 7, wherein said spheroid body having a first end with a circle of a fourth color.

9. The apparatus of claim 1, wherein said at least one tossing object having at least one of a cherry theme and an olive theme.

10. The apparatus of claim 1, wherein said container having at least one of a tumbler theme and a martini glass theme.

11. The apparatus of claim 1, wherein said apparatus having an adult beverage theme.

12. The apparatus of claim 1, wherein said at least one shelf is in communication with a second face of said at least one wall.

13. A method of operating an apparatus for throwing a tossing object into a container, comprising:

providing said apparatus comprising said tossing object and said container, said container having at least one wall and a container base in fixed communication, defining a volume, said volume having an open end with said container base opposite said open end;

placing an insert in detachable communication with said container, within said volume of said container, said insert having an insert base, said insert base resting on at least one shelf, said at least one shelf attached to said at least one wall, said insert including first and second adjacent interconnected cubic objects affixed to said insert base, positioned towards said open end, and separated by a first angle defined by said interconnection, said interconnection defining a resting point within said first angle, and said tossing object having a spherical body or a spheroid body having a dimension insertable into said first angle and removably positioned upon said point;

placing said container at a location;

positioning an operator holding said tossing object at a distance from said container; and said operator advancing said tossing object in a direction of said container and said insert.

14. The method of claim 13, further comprising advancing said tossing object towards said container in a palming action.

15. The method of claim 13, further comprising holding said tossing object by a shaft.

16. The method of claim 15, further comprising advancing said tossing object towards said container in a rotational action.

* * * * *